US006089063A

United States Patent [19]

Noé et al.

[11] Patent Number: 6,089,063

[45] Date of Patent: Jul. 18, 2000

[54] METHOD OF AND APPARATUS FOR PRODUCING ROLLED OR CAST METAL STRIP WITH DESCALED SURFACES

[75] Inventors: Rolf Noé, Mülheim/Ruhr; Andreas Noé, Kerken, both of Germany

[73] Assignee: BWG Bergwerk- und Walzwerk-Maschinenbau GmbH, Duisburg, Germany

[21] Appl. No.: 09/167,304

[22] Filed: Oct. 6, 1998

[30] Foreign Application Priority Data

Nov. 8, 1997 [DE] Germany ..... 197 49 466

[51] Int. Cl.[7] ..... B21B 45/04; B21C 43/00

[52] U.S. Cl. ..... 72/39

[58] Field of Search ..... 72/39, 40, 46, 72/200, 201, 202, 128, 160, 227; 148/602, 603, 661, 657, 645

[56] References Cited

U.S. PATENT DOCUMENTS

| | | | |
|---|---|---|---|
| 3,049,314 | 8/1962 | Criger | 242/527.5 |
| 5,554,235 | 9/1996 | Noe et al. . | |
| 5,704,237 | 1/1998 | Noe et al. . | |

FOREIGN PATENT DOCUMENTS

| | | | |
|---|---|---|---|
| 0 509 177 A2 | 10/1992 | European Pat. Off. . | |
| 6-73516 | 3/1994 | Japan | 148/645 |

*Primary Examiner*—Rodney A. Butler
*Attorney, Agent, or Firm*—Herbert Dubno

[57] ABSTRACT

A method of descaling rolled or cast metal strip, especially stainless steel or titanium-alloy steel strip in which the initial descaling is effected in a stretch-bend leveler and the annealing furnace directly follows the stretch-bend leveler and is directly followed by a pickling station so that any shot blast or brush descaler upstream of the annealing furnace is not required.

6 Claims, 2 Drawing Sheets

METHOD OF AND APPARATUS FOR PRODUCING ROLLED OR CAST METAL STRIP WITH DESCALED SURFACES

FIELD OF THE INVENTION

Our present invention relates to a method of and an apparatus for the production of rolled or cast metal strip, especially steel strip of stainless steel and titanium alloyed steel, with descale surfaces. The invention in particular relates to a method of and an apparatus for the treatment of rolled metal strip, especially steel strip, including both hot rolled and cold rolled strip.

BACKGROUND OF THE INVENTION

In the production of metal strip, whether from a rolled or cast product and especially steel strip of stainless steel or titanium-alloyed steel, it has been proposed to effect a descaling of the metal strip in the strip fabrication line, i.e. in the hot-rolled or cold-rolled strip line by initially annealing the strip and then effecting a descaling or initial descaling by a stretch-bend operation. Stretch bend leveling is a leveling of the strip carried out while the strip is under tension by passing the strip between rollers which bend the strip alternately in opposite directions (see the Making, Shaping and Treating of Steel, United States Steel Co., 10th edition, 1985, pages 1096 and 1097 by way of example).

The strip is then subjected to shot blasting and/or wire brushing (see for example op. Cit. page 1095), followed by a final chemical descaling, sometimes referred to as an after-descaling so that the result is a metal strip surface, e.g. a steel strip surface which is clean and free from scale. The annealing appears to serve as a means for overcoming the cold hardening. Shot blasting and brushing of the metal strip is a particularly time-consuming procedure which utilizes apparatus elements greatly increasing the cost of the strip processing line. Both shot blasting and brushing are associated with high operating cost and maintenance costs as well.

OBJECTS OF THE INVENTION

It is the principal object of the present invention to provide a method of producing rolled or cast metal strip, especially hot-rolled or cold-rolled steel strip of stainless steel or titanium-alloyed steel in which the descaling is carried out at reduced cost and in an optimal fashion.

It is another object of the invention to provide a method of descaling such metal strip which provides an improved product with reduced capital and operating cost.

Still another object of the invention is to provide an improved method of producing descaled metal strip which will yield a high quality product without drawbacks characterizing earlier systems.

A further object of the invention is to provide an improved apparatus for carrying out the method of the invention.

SUMMARY OF THE INVENTION

These objects and others which will become apparent hereinafter are attained, in accordance with the invention, in a method of producing descaled metal strip or with an apparatus for producing descaled metal strip wherein directly prior to the annealing a stretch-bend leveling is carried out on the strip and the pickling directly follows the annealing. The term "directly" as used here means that the two stages are effected without intervening processing. Of course prior to the stretch-bend leveling, subsequent to the pickling, the strip can be stored, e.g. in one or more loops, without altering the fact that the stretch-bend leveling is effected immediately prior to annealing and the pickling is carried out immediately following the annealing, since such storage does not constitute a processing of the stretch in the sense of the invention.

Surprisingly the mechanical predescaling, i.e. the initial descaling by the stretch-bend leveling, is significantly better when it is carried out prior to the annealing. Indeed, the metal strip and especially stainless steel strip are descaled in this initial stage sufficiently that usually no shot blasting and/or brushing is necessary and the strip can pass through the strip line at maximum speed while nevertheless yielding strip surfaces which, following the pickling, are completely clean.

The descaling can be optimized and the entire descaling process made less expensive. Because it is possible to eliminate a shot blasting and/or brushing operation, the apparatus for carrying out the method of the invention is simplified and the capital costs are reduced. The stations hitherto found to be necessary for shot blasting and/or wire brushing can be completely eliminated.

The apparatus can comprise a source of the strip to be descaled, namely an upstream part of a rolling line or an uncoiler for delivering the strip from a previously formed coil thereof. The uncoiler can be followed by a welding station in which an end from a trailing end from a prior coil can be connected to the leading end of a subsequent coil. The welder can be directly followed by a stretch-bend leveler to effect the mechanical prescaling. That descaler is followed by the annealing station and the annealing is directly followed by the pickling station or chemical and/or electrolytic descaling prior to recoiling of the descaled strip on a coiling unit. In this apparatus, of course, the stretch-bend leveler is provided directly ahead of the annealing furnace and the pickling station is located directly downstream of the annealing station. In apparatus terms as well the strip storage loops can be provided upstream of and/or downstream of the stretch-bend leveler.

The descaling line without the shot blasting and brushing machine has been found to be advantageous both with respect to hot-rolled strip and cold-rolled strip.

In a strip line in which the conversion of the strip line from the processing of hot-rolled strip to the processing of cold-rolled strip has hitherto required the elimination of the shot blasting stage, since shot blasting tended to damage the surface of cold-rolled strip, the invention provides the advantage that the shot blasting apparatus can be eliminated entirely and the line operator need not be concerned with any processes for cutting out the shot blasting unit.

In addition, it is unnecessary to take out of the line various roll stands which hitherto have been deemed to be necessary in a switchover between hot-rolled strip and cold-rolled strip. The result is a reduction in the down time of the production line in the case of a switchover and an increase in the overall productivity of such lines. As has been noted, strip storage loops can be provided upstream and/or downstream of the stretch-bend unit. Such strip storage units allow the strip to move continuously through the system and avoids the problem with marking of the strip when the strip comes to standstill, for example for the welding of a leading end of a new strip to the trailing end of a prior strip or for other reasons. The strip storage units allow continuous movement through the strip line. The inlet storage unit upstream of the stretch-bend leveler can be relatively small since it is only necessary to permit creeping of the strip through this unit and at the inlet side to eliminate drawbacks with respect to strip marking.

In special cases it is possible to provide upstream or downstream of the annealing station, shot blasting and/or brushing machines, for example when the metal strip is difficult to descale and descaling cannot be complete as a result of the stretch-bend leveling and pickling. In that case, the strip can be mechanically descaled both by the stretch-bend leveling and by the shot blasting and/or brushing. Following the pickling operation, a dressing stand and/or a further stretch-bend leveler can be provided. The dressing stand can use textured rollers when a patterned strip surface is desired. The dressing stand and/or final stretch-bend leveler can be used to impart the desired planarity, surface roughness and brightness to the surfaces. It is also possible following the descaling, in conjunction with the stretch-bend leveling or prior to recoiling the split strip longitudinally and/or to trim the strip.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
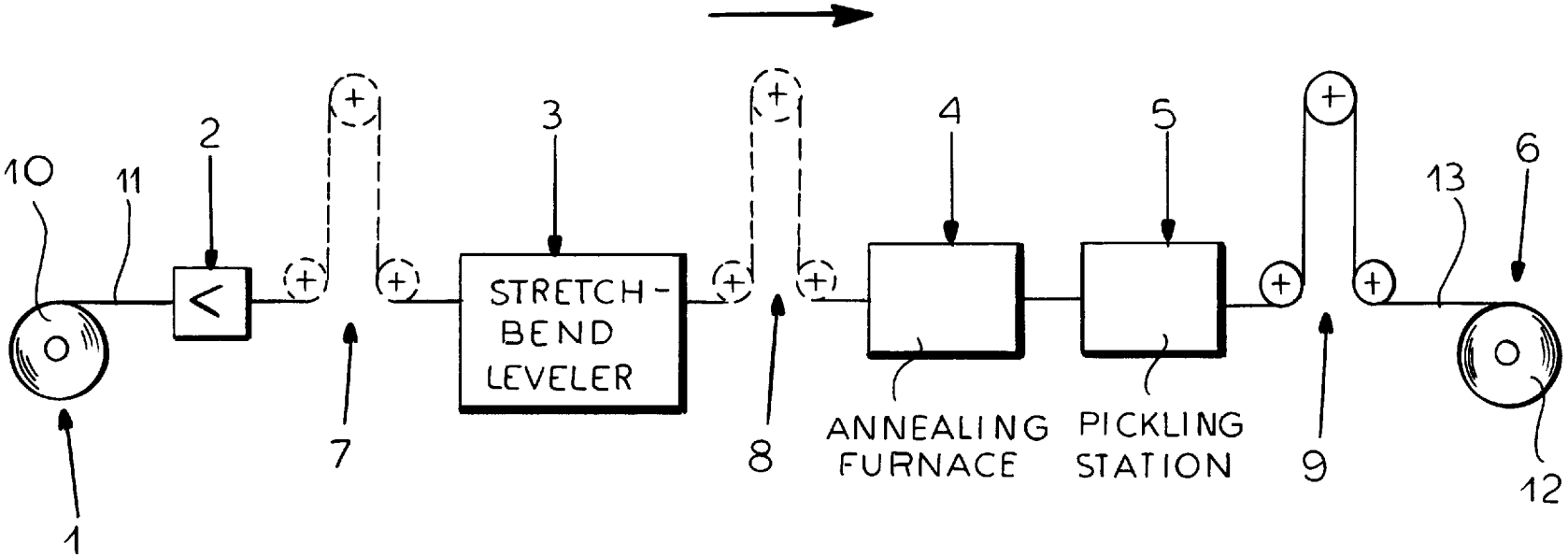
FIG. 1 is a diagram of a strip line according to the invention.

In FIG. 1 we have shown, as an example of a strip descaling line of the invention, and in highly diagrammatic form, an unwinding station 1 from which a coil 10 of the strip 11 is unwound and fed to a welding machine 2 serving to attach the leading end from this coil to the trailing end of a previous coil so that the strip can pass continuously through the apparatus. Of course, the source of the strip 11 can be a rolling line.

The strip passes through a stretch-bend leveler 3 acting as the initial descaling unit and then through the annealing furnace 4 and the pickling station 5 before being rewound in a coil 12 as descaled strip 13 at the rewinding station 6. In the commonly-owned U.S. Pat. Nos. 5,554,235 and 5,704,237, there are described such units as stretch-bend levelers, annealing furnaces and pickling stations.

What is important to the present invention is that the stretch-bend leveler 3 is located directly ahead of the annealing station 4 and the pickling station 5 is located directly behind the annealing furnace 4.

In addition, upstream of and downstream of the stretch-bend leveler 3, strip storage loops 7 and 8 can be provided. These have been shown in broken lines since they are completely optional. A further strip storage loop is customarily located downstream of the pickling station 5. Between this strip storage loop and the rewinding station 6, a shear can be provided to sever the descaled strip after each coil has been rewound.

Figure 2:
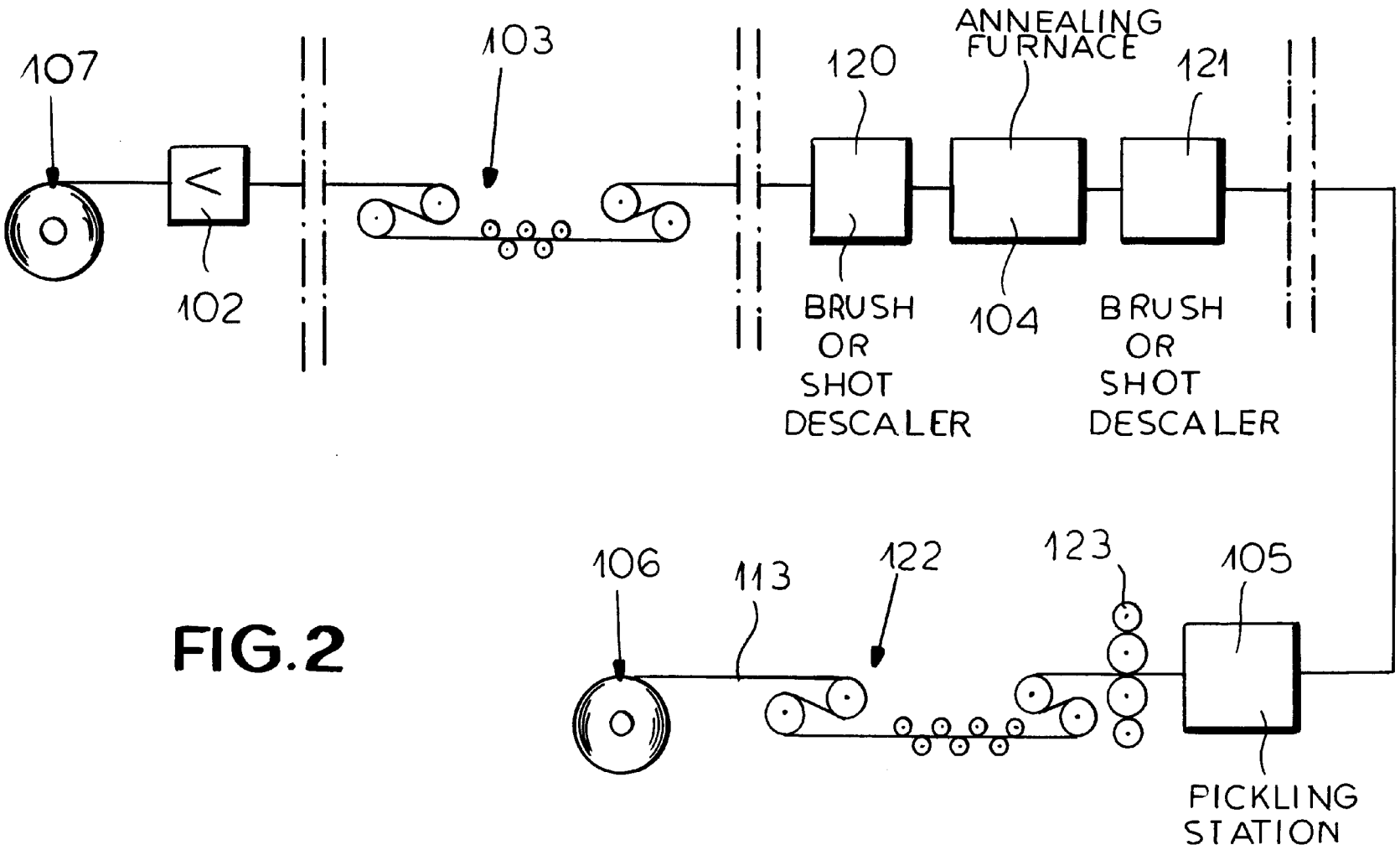
FIG. 2 is a diagram of a modification thereof.

Although less preferred, the invention can include a line as in FIG. 2 for especially difficult to descale stainless steel or titanium-alloy steel strip. Here the unwinding station 107, the welding station 102 and the stretch-bend leveler 103 are provided as in the embodiment of FIG. 1, but upstream of the annealing furnace 104 and downstream thereof brush or shot blasting descalers 120 and 121 can be provided. Downstream of the pickling station 105, a further stretch-bend leveler 122 can be provided and optionally a dressing roll stand 123 can be located downstream of the pickling station 105 for imparting a final degree of planarity and surface brightness to the descaled strip 113 before it is wound up on the recoiler 106. Brush or shot blast descalers, dressing stands and the like are also described in the commonly-owned U.S. Pat. No. 5,554,235. The strip-storage loops can be provided between the welder 102 and the stretch-bend leveler, between the latter and the shot-blast descaler 120 and between the shot blast descaler 121 and the pickier 105.

Surprisingly, although the initial stage stretch-bend leveler 3 or 103 precedes the annealing station and in most cases neither shot blast descaling or brushing units are required upstream of the annealing station to ensure a bright descale surface finish of stainless steel strip or titanium-alloy steel strip, a high quality descaled product can be obtained.

We claim:

1. A strip descaling line comprising:

an unwinding station for delivering a metal strip to be descaled;

a stretch-bend leveler forming an initial descaler and traversed by the metal strip;

an annealing furnace downstream of said stretch-bend leveler for directly annealing said metal strip after stretch-bend leveling thereof in said stretch-bend leveler and without intervening processing of the strip;

a pickling station directly downstream from said annealing furnace and for pickling said strip after it has been annealed in said annealing furnace and without intervening processing of the strip; and a rewinding station for forming a coil from descaled strip from said pickling station.

2. The strip descaling line defined in claim 1, further comprising a strip storage upstream of said stretch-bend leveler.

3. The strip descaling line defined in claim 1, further comprising a strip storage downstream of said stretch-bend leveler.

4. The strip descaling line defined in claim 3, further comprising a strip storage upstream of said stretch-bend leveler.

5. The strip descaling line defined in claim 4, further comprising a strip storage downstream of said stretch-bend leveler.

6. A method of descaling rolled or cast metal strip which comprises the steps of:

(a) initially descaling said metal strip by passing said metal strip through a stretch-bend leveler;

(b) directly following the passage of said metal strip through said stretch-bend leveler and without intervening processing of the strip, annealing said metal strip; and (c) directly following annealing of said metal strip and without intervening processing of the strip, pickling said metal strip to yield a descaled strip product.

* * * * *